US009358680B1

(12) United States Patent
Krueger

(10) Patent No.: US 9,358,680 B1
(45) Date of Patent: Jun. 7, 2016

(54) WALL-MOUNTED TOOL ORGANIZER

(71) Applicant: Howard T. Krueger, Chesterfield, MO (US)

(72) Inventor: Howard T. Krueger, Chesterfield, MO (US)

( * ) Notice: Subject to any disclaimer, the term of this patent is extended or adjusted under 35 U.S.C. 154(b) by 0 days.

(21) Appl. No.: 14/727,989

(22) Filed: Jun. 2, 2015

Related U.S. Application Data

(60) Provisional application No. 62/050,451, filed on Sep. 15, 2014.

(51) Int. Cl.

| | |
|---|---|
| ***A47B 81/00*** | (2006.01) |
| ***B25H 3/00*** | (2006.01) |
| ***A47B 95/02*** | (2006.01) |
| ***A47B 96/20*** | (2006.01) |

(52) U.S. Cl.
CPC *B25H 3/00* (2013.01); *A47B 81/00* (2013.01); *A47B 95/02* (2013.01); *A47B 96/20* (2013.01); *A47B 2095/024* (2013.01); *A47B 2220/0061* (2013.01)

(58) Field of Classification Search
CPC ..... B25H 3/00; A47B 81/00; A47B 95/02; A47B 2095/024; A47B 2200/0061
USPC ..... 206/372, 373
See application file for complete search history.

(56) References Cited

U.S. PATENT DOCUMENTS

| | | | | | |
|---|---|---|---|---|---|
| 3,878,939 | A | | 4/1975 | Wilcox | |
| 5,114,007 | A | * | 5/1992 | Chen | B25H 3/028 206/373 |
| 5,271,501 | A | * | 12/1993 | Chen | B25H 3/06 206/373 |
| 5,570,784 | A | | 11/1996 | Sidabras et al. | |
| 5,725,096 | A | * | 3/1998 | Winnard | B25H 3/06 206/350 |
| 5,915,554 | A | * | 6/1999 | Hung | B65D 51/002 206/372 |
| 6,068,123 | A | * | 5/2000 | Chen | B25H 3/028 206/373 |
| 6,185,303 | B1 | * | 2/2001 | Losey | A47B 96/06 248/219.4 |
| 6,681,940 | B1 | | 1/2004 | Cash et al. | |
| 6,837,383 | B1 | | 1/2005 | McElhaney, Jr. | |
| 6,968,961 | B1 | | 11/2005 | Peete | |
| 7,055,689 | B2 | | 6/2006 | Chen | |
| 7,073,672 | B2 | | 7/2006 | Sholem | |
| 8,701,952 | B1 | | 4/2014 | Tripp | |
| 2002/0117414 | A1 | * | 8/2002 | Kipper | B25H 3/023 206/373 |
| 2003/0146123 | A1 | * | 8/2003 | Michael | B65D 81/113 206/373 |
| 2004/0035748 | A1 | * | 2/2004 | Hernandez, Jr. | B25H 3/023 206/748 |
| 2004/0182730 | A1 | * | 9/2004 | Lee | B25H 3/00 206/349 |
| 2008/0083634 | A1 | * | 4/2008 | Parker | B25H 3/023 206/373 |
| 2009/0071854 | A1 | * | 3/2009 | Martin | G06Q 10/087 206/373 |
| 2010/0046791 | A1 | * | 2/2010 | Glickman | G06K 9/209 382/100 |
| 2012/0175277 | A1 | * | 7/2012 | Hutchens | G09F 23/00 206/372 |
| 2013/0037559 | A1 | | 2/2013 | Fierek | |
| 2014/0217861 | A1 | * | 8/2014 | Cole | B25H 3/00 312/205 |

OTHER PUBLICATIONS http://ahlbornequipment.com/images/products/detail/WT24HA.jpg (Apr. 25, 2012).
http://www.foampackaging.co.uk/wp-content/uploads/2014/03/tool-inserts.jpg (Apr. 9, 2014).

* cited by examiner

*Primary Examiner* — Daniel Rohrhoff
(74) *Attorney, Agent, or Firm* — Robert C. Montgomery; Montgomery Patent & Design LP

(57) ABSTRACT

A hand tool organizer adapted to be mounted on a wall or door and configured to retain a plurality of tools via profile recesses, where each slidably received tool matches a corresponding recess. The organizer is further provided with side-pivoting doors and slide-out drawers.

10 Claims, 5 Drawing Sheets

WALL-MOUNTED TOOL ORGANIZER

RELATED APPLICATIONS

The present invention was first described in and claims the benefit of U.S. Provisional Application No. 62/050,451 filed Sep. 15, 2014, the entire disclosures of which are incorporated herein by reference.

FIELD OF THE INVENTION

The present invention relates generally to a hand tool organizer adapted to be mounted on a wall or door and configured to retain a plurality of tools.

BACKGROUND OF THE INVENTION

As anyone who performs a lot of mechanical work will attest, nothing beats having the proper tool for a job. The proper tool can save time, save money, produce a higher quality job, reduce damage to equipment, and provide for the increased safety of the worker.

Keeping commonly used hand tools in an organized manner is an issue for many people. The hand tools, interchangeable parts, drill bits, containers, and the like quickly become cumbersome to maintain in an organized manner. It is also of particular importance to not only maintain these items in an organized manner but to store such items near or adjacent to a work area while preferably keeping items not in use out of the way.

Various ways to store these items are known. A common problem with all these systems is the inherent lack of organization. Another problem area is the location of such an organizer device, which usually involves storing on the very workspace to be used, thereby restricting the available workspace area. Accordingly, there exists a need for a means by which tools can be easily stored and organized in a convenient manner which addresses the problems as described above. The development of the wall-mounted tool organizer fulfills this need.

SUMMARY OF THE INVENTION

The inventor has recognized the aforementioned inherent problems and lack in the art and observed that there is a need for a wall-mounted tool organizer.

It is therefore an object of the invention to provide a tool organizer comprising an enclosure including a first side surface, a second side surface, a partial front surface, a top surface, and a rear surface. The tool organizer also comprises a tool panel which itself includes a plurality of tool cavities on a front surface thereof, and disposed and bonded within an interior of the enclosure. The tool organizer also comprises a first door assembly having a first side pivotally attached to a front edge of the first side surface and a second side removably secured to the partial front surface and a second door assembly having a first side pivotally attached to a front edge of the second side surface and a second side removably secured to the partial front surface.

The first door assembly and the second door assembly are each pivotally attached by at least one (1) hinge. Each tool cavity comprises an outline of a common tool profile. Each tool cavity also comprises at least one retaining feature extending inwardly from a side wall. Each retaining feature is adapted to retain a tool therein. Each retaining feature comprises a small integrally molded protrusion which creates an interference fit with the tool placed within the tool cavity. The tool panel comprises at least two (2) finger relief areas on opposing sides of each tool cavity.

The first and second door assemblies each comprise a handle on an outer surface thereof wherein each handle is integrally molded into a respective first or the second door assembly. The tool organizer further comprises a plurality of drawer openings within the partial front surface and a plurality of drawers. Each drawer comprises an integral rectangular drawer front panel having an integral drawer pull handle upon a forward-facing surface. Each drawer also comprises a rearwardly extending drawer box which provides a rectangular inner space. Each drawer also comprises a provision for at least one (1) removably insertable internal partition.

The first and second door assemblies are removably secured to the partial front surface with a plurality of magnets and a correspondingly positioned one (1) of a plurality of steel plates. The plurality of magnets is mounted along a perimeter edge of the first and second door assemblies and the plurality of steel plates are mounted along respective contact surfaces along a perimeter edge. When each magnet is capable of magnetic connection to a respective steel plate.

The mounting further comprises a male mounting fixture and a female mounting fixture. The male mounting fixture comprises at least one (1) plate having a plurality of apertures and an offset cylindrical button appendage. The female mounting fixture comprises at least one (1) plate having a plurality of apertures and at least one (1) keyhole-shaped aperture wherein the female plate has an integral offset first ear and an integral offset second ear located on opposing end portions.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
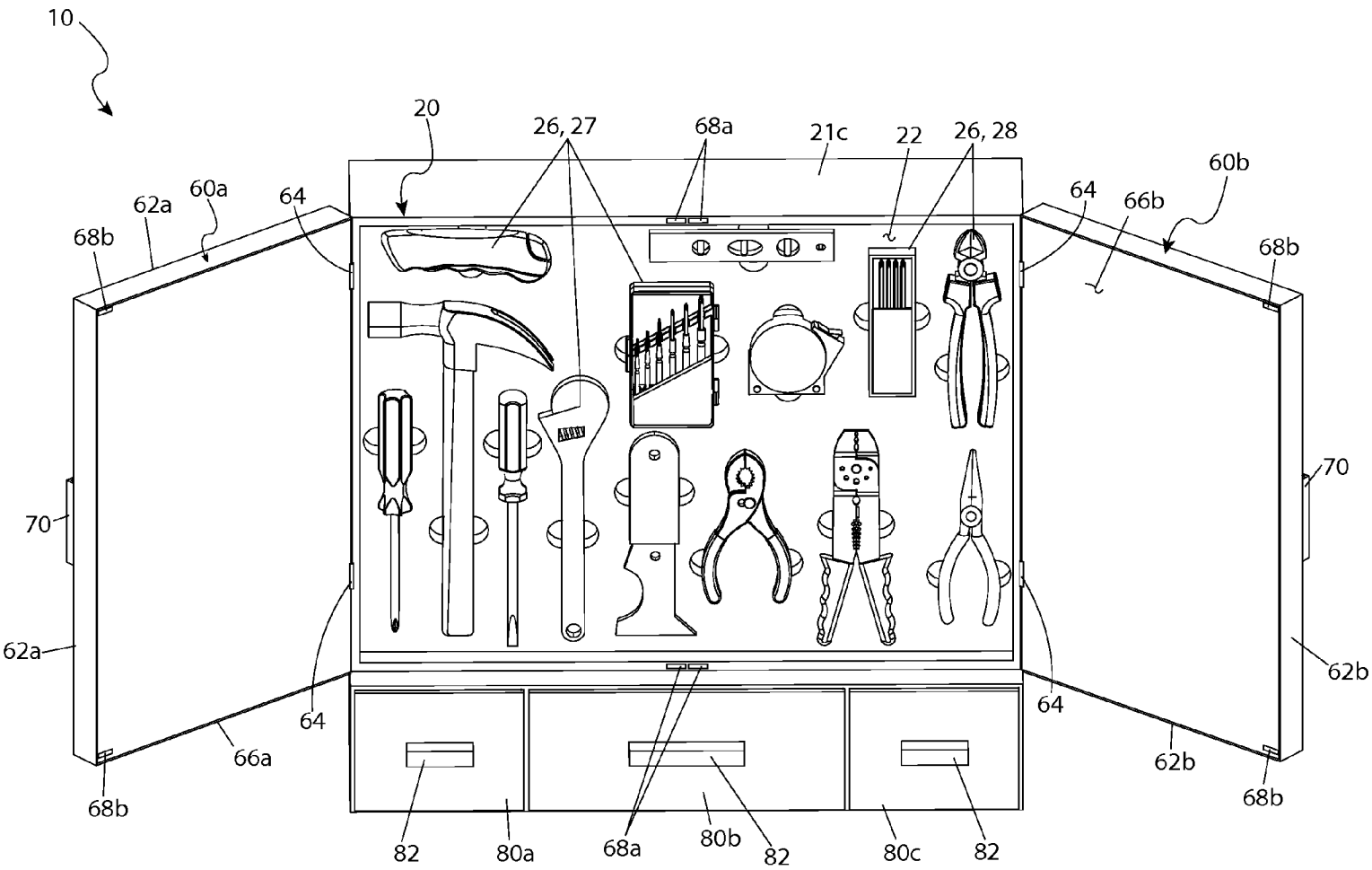
FIG. 1 is a front perspective view of a wall-mounted tool organizer 10, according to a preferred embodiment of the present invention.

10 wall-mounted tool organizer
20 enclosure
21*a* side surface
21*b* front surface
21*c* top surface
21*d* rear surface
22 tool panel
26 tool item
27 tool cavity
28 retaining feature
29 finger relief

30 male mounting fixture
31 rear plate
32 appendage
35 female mounting fixture
36 front plate
38*a* first ear
38*b* second ear
40 aperture
60*a* first door assembly
60*b* second door assembly
62*a* first door frame
62*b* second door frame
64 hinge
66*a* first inner panel
66*b* second inner panel
68*a* magnet
68*b* steel plate
70 door pull handle
80*a* first drawer
80*b* second drawer
80*c* third drawer
82 drawer pull handle
84 drawer front panel
85 drawer box
86 drawer opening
88*a* tongue
88*b* groove
90 inner space
92 partition
94 slot
100 structural member
180 fastener

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a wall-mounted tool organizer (herein described as the "apparatus") 10, which provides a variety of commonly used tool items 26 discreetly contained within a cabinet-type enclosure 20 having frontal swinging doors 60*a*, 60*b* and a plurality of pull-out drawers 60*a*, 60*b*, 60*c*.

Figure 2:
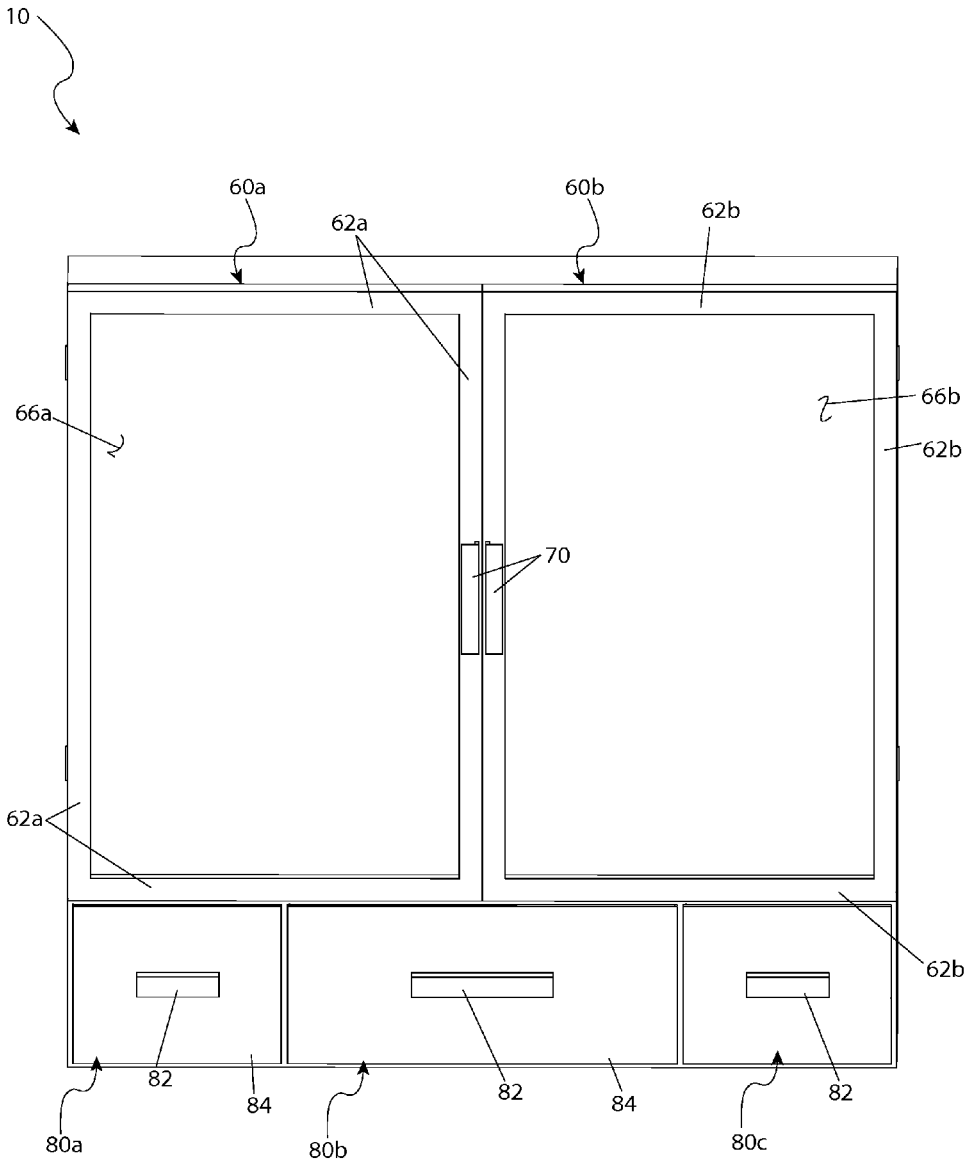
FIG. 2 is another front perspective view of a wall-mounted tool organizer 10 depicting closed door portions 60*a*, 60*b*, according to a preferred embodiment of the present invention.

Referring now to FIGS. 1 and 2, front perspective views of the apparatus 10 depicting open and closed door portions 60*a*, 60*b*, according to a preferred embodiment of the present invention, are disclosed. The apparatus 10 provides an enclosure 20 which provides an open-front shallow box structure including a pair of side surfaces 21*a*, a partial front surface 21*b*, a top surface 21*c*, and a rear surface 21*d*. The enclosure 20 provides access and compact storage of a plurality of common tool items 26 therein, via an internal tool panel 22 which is bonded within the enclosure 20 and includes a plurality of tool cavities 27 along a front surface thereby enabling removable insertion and mechanical retention of the tool items 26 within the respectively shaped cavity portions 27 via an interference fit (see FIG. 3).

The enclosure 20 includes hinged attachment of pivoting first door assembly 60*a* and second door assembly 60*b* portions along opposing frontal edges of the side surfaces 21*a*. The hinges 64 are to be integrally-molded into the side surfaces of the enclosure 20 and the door assemblies 60*a*, 60*b*. The hinges 64 include complimenting interlocking elements being mechanically engaged so as to allow the doors 60*a*, 60*b* to swing independently outward a full one-hundred and eighty (180°) degrees. The door assemblies 60*a*, 60*b* provide mirror-image shallow box-like structures having perimeter shapes which cover a half-portion of the enclosure 20, effectively covering an entire front surface of the enclosure 20 when the door assemblies 60*a*, 60*b* are in a closed state. The door assemblies 60*a*, 60*b* may be closed to discreetly conceal the tool items 26 whenever desired. The door assemblies 60*a*, 60*b* include respective first door frame 62*a* and second door frame 62*b* portions which provide rigid perimeter structures. The door frames 62*a*, 62*b* are covered along a rear surface by respective first inner panel 66*a* and second inner panel 66*b* portions forming a decorative recessed front surface when in the closed state. It is understood that when in a closed state, the forward-facing surface of the inner panels 66*a*, 66*b* may be decorated with various colors, patterns, pictures, indicia, and the like based upon a user's preferences.

The door assemblies 60*a*, 60*b* are held a closed state against the enclosure 20 via magnets 68*a*, or an equivalent non-locking closure means. It is envisioned that a plurality of magnets 68*a* and correspondingly positioned attracting steel plates 68*b* would be mounted along respective contact surfaces along perimeter edges of the enclosure 20 and door assembly 60*a*, 60*b* portions. The magnets 68*a* and plates 68*b* are envisioned to be molded-in, fastened, adhesively bonded, or otherwise affixed thereto respective surfaces.

The enclosure 20, tool panel 22, and door 60*a*, 60*b* portions are preferably made of a plastic material preferably utilizing a reinforcing fiberglass blend composition to provide strength and durability. The plastic material is to have sufficient strength to operably enable the integrally-molded hinges 64 which attach the doors 60*a*, 60*b* to the enclosure 20; however, it is understood that the portions of the apparatus 10 may be introduced being partially or completely made of other physically equivalent materials, such as wood, composite wood materials, or the like, with equal benefit, and as such should not be interpreted as a limiting factor of the invention 10.

Each door assembly 60*a*, 60*b* provides a means of opening via respective protruding door pull handles 70 preferably being integrally-molded into the door assemblies or otherwise mounted thereto using common fasteners. Additionally, the enclosure 20 provides a plurality of sliding drawers 80*a*, 80*b*, 80*c* within the partial front surface 21*b* for the storage of small related items (see FIG. 5). The apparatus 10 is envisioned to be introduced in various overall sizes having a variety of width and height dimensions, and providing attractive external colors and patterns based upon a user's preference.

Figure 3:
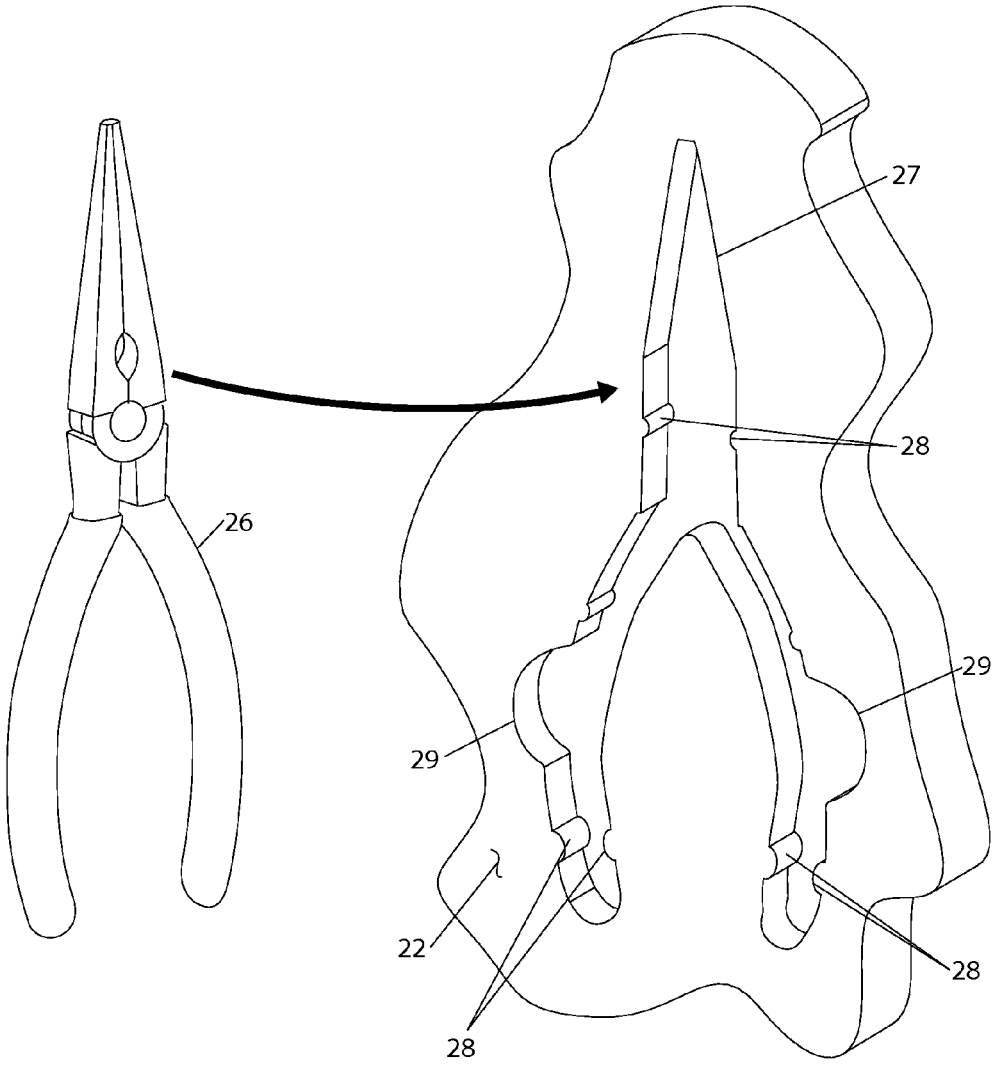
FIG. 3 is a close-up view of a tool cavity portion 27 of the wall-mounted tool organizer 10, according to a preferred embodiment of the present invention.

Referring now to FIG. 3, a close-up view of a tool cavity portion 27 of the apparatus 10, according to a preferred embodiment of the present invention, is disclosed. The tool panel portion 22 bonded within the enclosure 20 provides a plurality of tool cavities 27 being shaped so as to allow insertion and retention of correspondingly shaped tool items 26. The apparatus 10 is envisioned to be provided in several models having different combinations of tool items 26 representing different themes which correspond to various applications such as, but not limited to: general household tools such as screwdrivers and hammers, woodworking tools such as saws and chisels, mechanical shop tools such as crescent wrenches and socket wrenches, gardening tools such as shovels and shears, and the like.

The tool cavities 27 are arranged along a front surface of the tool panel 22 in an efficient space-saving manner and provide removable form-fitting insertion and mechanical retention of the tool items 26 via a plurality of retaining features 28 integrally-molded along inside edge portions of each tool cavity 27. The retaining features 28 are envisioned to provide small integrally-molded protrusions which create a slight interference fit with the tool item 26 while within the tool cavity 27, thereby securely retaining the tool item 26 therein. Furthermore, the tool cavity 27 provides at least two (2) finger relief portions 29 to allow easy grasping and removal of the tool item by a user from the tool cavity 27.

Figure 4:
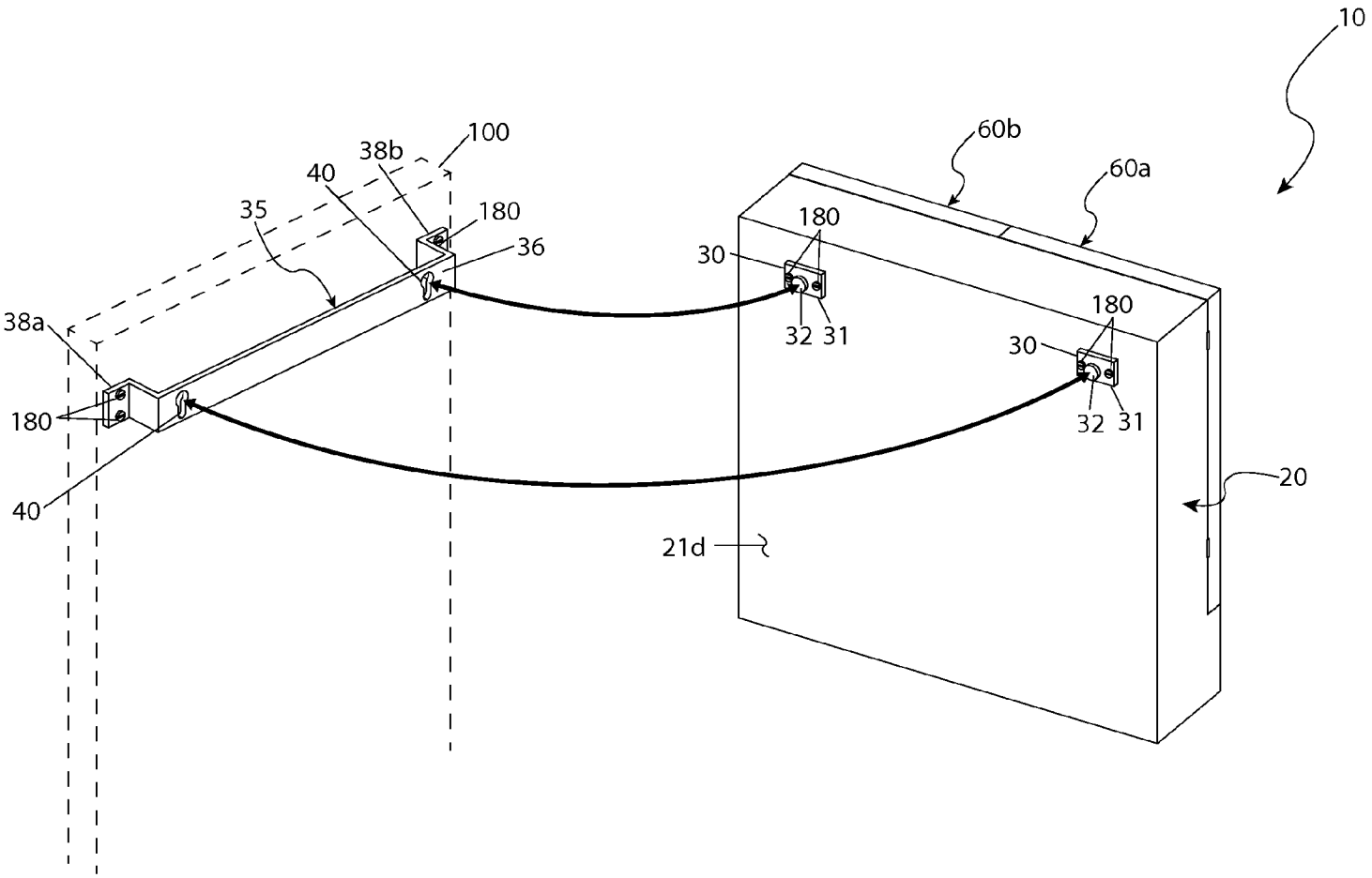
FIG. 4 is a rear perspective view of the wall-mounted tool organizer 10 depicting a mounting means, according to a preferred embodiment of the present invention; and, FIG. 5 is a partially exploded view of the wall-mounted tool organizer 10 depicting drawer portions 80*a*, 80*b*, 80*c*, according to a preferred embodiment of the present invention.

Referring now to FIG. 4, a rear perspective view of the apparatus 10 depicting a mounting means, according to a preferred embodiment of the present invention, is disclosed. An embodiment of a mounting means is illustrated here depicting a pair of male mounting fixtures 30 and a single female mounting fixture 35. The mounting fixtures 30, 35 act to securely mount the apparatus 10 to a structure 100 such as a wall, a door, and the like. It is understood that additional male 30 and female 35 mounting fixtures may be utilized for further securement of the apparatus 10, as well as utilizing various other mechanical methods to temporarily or permanently secure the apparatus 10 to a structure 100 without deviating from the teachings of the apparatus 10, and as such should not be interpreted as a limiting factor of the invention 10.

The male mounting fixtures 30 and female mounting fixtures 35 depicted here provide removable attachment of the apparatus 10 to a flat vertical surface, preferably being a door or wall structure 100 via respective interlocking appendage 32 and aperture 40 portions. The male mounting fixtures 30 are shown here including a rear plate 31 portion for mounting to the rear surface portion 21*d* of the enclosure 20 using fasteners 180 such as screws, and an integral appendage portion 32. The appendage 32 provides an offset cylindrical "button" being sized and positioned for insertion into a correspondingly sized and shaped "key-hole" shaped aperture portion 40 of the female mounting fixture 35. The female mounting fixture 35 provides a horizontally extending front plate 36 having integral "L"-shaped offset first ear 38*a* and second ear 38*b* portions located at opposing end portions. The ears 38*a*, 38*b* provide a means to securely mount the female mounting fixture 35 to the structure 100 using fasteners 180 such as screws, lag bolts, or wall anchors.

Engagement of the male fixtures 30 with the female fixtures 40 is accomplished by pre-installing the female mounting fixture 35 to the structure 100, inserting each appendage 32 into a corresponding aperture 40, and lowering the apparatus 10 slightly to lock it in place.

Figure 5:
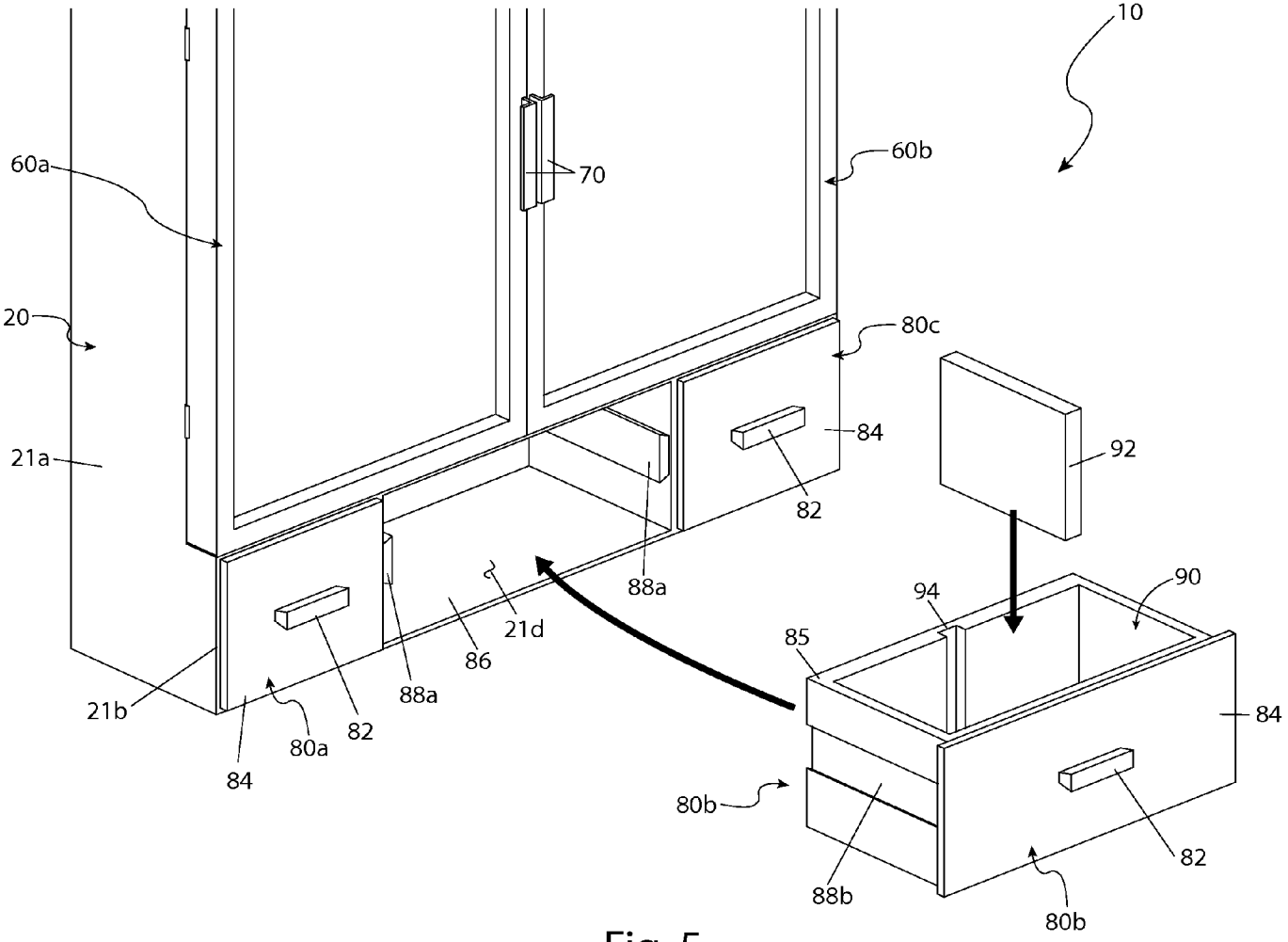

Referring now to FIG. 5, a partially exploded view depicting drawer portions 80*a*, 80*b*, 80*c* of the apparatus 10, according to a preferred embodiment of the present invention, is disclosed. The apparatus 10 provides a means for storing related items such as drill bits, fasteners, measuring devices, and the like within drawers 80*a*, 80*b*, 80*c* which are inserted into drawer openings 86 located along the lower front surface portion 21*b* of the enclosure 20. An embodiment of the apparatus 10 is illustrated here having three (3) drawer units having differing width dimensions including a first drawer 80*a*, a second drawer 80*b*, and a third drawer 80*c*; however, it is understood that different numbers and sizes of drawers may be introduced based upon a user's preference, and as such should not be interpreted as a limiting factor of the apparatus 10.

Each drawer 80*a*, 80*b*, 80*c* includes an integral rectangular drawer front panel 84 having an integral or otherwise affixed drawer pull handle portion 82 upon a forward-facing surface. Each drawer 80*a*, 80*b*, 80*c* also includes a rearwardly extending drawer box 85 which provides a rectangular inner space 90 for storing small related items. The enclosure 20 provides a means of guided insertion of each drawer box 85 into respective drawer opening portions 86 via respective tongue 88*a* and groove 88*b* portions. Each drawer box 85 includes provisions for at least one (1) removably insertable internal partition 92 for the separation of contained items, if desired. The partitions 92 are envisioned to be flat rectangular members which are inserted vertically across the inner space 90 in a slip-fit manner into corresponding slot portions 94 formed along inner surfaces of each drawer box 85.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of installing the apparatus 10 may be achieved by performing the following steps: procuring a model of the apparatus 10 having desired width and height dimensions, external appearance, and desired set of tool items 26; selecting a location upon a structure 100 onto which the apparatus 10 is to be mounted; mounting at least one (1) female mounting fixture 35 to the structure 100 using fasteners 180 such as screws, lag bolts, or wall anchors; attaching the rear plate portions 31 of the male mounting fixtures 30 to the rear surface portion 21*d* of the enclosure 20, if not previously installed, using suitable fasteners 180; mounting the enclosure 20 to the female mounting fixture 35 by inserting the appendage portions 32 of the male mounting fixture 30 into corresponding aperture portions 40 of the female mounting fixture 35; lowering the apparatus 10 slightly to lock the female mounting fixture 35 and male mounting fixture 30 portions together; opening one (1) or both of the door assemblies 60*a*, 60*b*; inserting a tool item 26 into a correspondingly shaped tool cavity 27, if not previously installed, by pressing the tool item 26 against the retaining feature portions 28 of the respective tool cavity 27; installing remaining tool items 26 in like manner until all tool items 26 are mounted within the tool panel 22; closing the door assemblies 60*a*, 60*b*; pulling the drawers 80*a*, 80*b*, 80*c* outwardly from the drawer openings 86; inserting a desired number of partitions 92 into the slot portions 94 of each drawer box 85; loading related supplies, materials, and small tools into the inner space portion 90 of each drawer 80*a*, 80*b*, 80*c* as needed; and, closing the drawers 80*a*, 80*b*, 80*c*. The apparatus 10 is now ready to provide discreet storage and convenient access to a variety of tool items 26 and other associated supplies as needed to perform a home improvement project, facilitate a repair, or execute various similar tasks.

The method of utilizing the apparatus 10 may be achieved by performing the following steps: grasping at least one (1) door pull handle 70 to release the magnets 68*a* from the steel plates 68*b* to enable opening of one (1) or both door assemblies 60*a*, 60*b*; locating a needed tool item 26 on the tool panel 22; grasping the tool item 26 by inserting one's fingers into the respective finger relief portions 29 of the tool cavity 27; extracting the tool item 26 from the tool cavity 27; opening the drawers 80*a*, 80*b*, 80*c* to access any needed supplies contained therein; repeating the above steps to extract additional tool items 26 as needed to complete a task; utilizing the tool items 26 as needed; replacing the tool items 26 onto the tool panel 22 by forcing the tool items 26 against the retaining feature portions 28 of the respective tool cavities 27; closing the door assemblies 60*a*, 60*b* until the magnets 28*a* and plates 28*b* secure the door assemblies 60*a*, 60*b* in their closed states; and, closing the drawers 80*a*, 80*b*, 80*c* using the drawer pull handles 82.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A tool organizer, comprising:

an enclosure including a first side surface, a second side surface, a partial front surface, a top surface, and a rear surface;

a tool panel, including a plurality of tool cavities on a front surface thereof, and disposed and bonded within an interior of said enclosure;

a first door assembly having a first side pivotally attached to a first edge of said first side surface and a second side removably secured to said partial front surface;

a second door assembly having a first side pivotally attached to a first edge of said second side surface and a second side removably secured to said partial front surface; and, at least one mounting means located on said rear surface adapted to mount said tool organizer to a support structure, each comprising:

a first plate having a first plurality of apertures and an offset cylindrical button appendage; and, a second plate having a second plurality of apertures and at least one keyhole shaped aperture;

wherein said second plate has an integral offset first ear and an integral offset second ear located on opposing end portions.

2. The tool organizer of claim 1, wherein each tool cavity comprises at least one retaining feature extending inwardly from a side wall thereof;

wherein each retaining feature is adapted to retain a tool therein.

3. The tool organizer of claim 2, wherein said tool panel comprises at least two finger relief areas on opposing sides of each tool cavity.

4. The tool organizer of claim 2, wherein each retaining feature comprises a small integrally molded protrusion;

wherein said protrusion creates an interference fit with said tool placed within said tool cavity.

5. The tool organizer of claim 1, wherein said first door assembly and said second door assembly are each pivotally attached by at least one hinge.

6. The tool organizer of claim 1, wherein each tool cavity comprises an outline of a common tool profile.

7. The tool organizer of claim 1, further comprising:

a plurality of drawer openings within said partial front surface; and, a plurality of drawers each slidably insertable within a respective drawer opening;

wherein each drawer comprises an integral rectangular drawer front panel having an integral drawer pull handle upon a forward-facing surface;

wherein each drawer comprises a rearwardly extending drawer box which provides an inner space;

wherein each drawer is guided by a respective tongue and a groove into each respective drawer opening within said enclosure; and, wherein each drawer comprises a provision for at least one removably insertable internal partition.

8. The tool organizer of claim 1, wherein said first and second door assemblies are removably secured to said partial front surface with a plurality of magnets and a correspondingly positioned one of a plurality of steel plates;

wherein said plurality of magnets are mounted along a perimeter edge of said first and second door assemblies and said plurality of steel plates are mounted along respective contact surfaces along a perimeter edge; and, wherein each magnet is capable of magnetic connection to an respective steel plate.

9. The tool organizer of claim 1, wherein said first and second door assemblies each comprise a handle on an outer surface thereof.

10. The tool organizer of claim 9, wherein each handle is integrally molded into a respective first or said second door assembly.

* * * * *